United States Patent [19]

Romano

[11] 4,276,954

[45] Jul. 7, 1981

[54] ADJUSTABLE LIGHT AND AIR-ADMITTING WINDOW THERMAL AND ACOUSTIC BARRIER SYSTEM

[75] Inventor: Paul L. Romano, Orange, Calif.

[73] Assignee: Acoustic Standards, Orange, Calif.

[21] Appl. No.: 80,337

[22] Filed: Oct. 1, 1979

[51] Int. Cl.[3] ..... E04F 17/04; E04B 1/343; E04B 1/82; E06B 9/26

[52] U.S. Cl. ..... 181/224; 160/236; 181/287; 181/288; 181/291

[58] Field of Search ..... 160/177, 236; 52/144, 52/145; 181/210, 224, 284–295

[56] References Cited

U.S. PATENT DOCUMENTS

| | | | |
|---|---|---|---|
| 2,160,638 | 5/1939 | Bedell et al. | 52/144 X |
| 2,217,217 | 10/1940 | Engstrom | 160/236 X |
| 2,590,204 | 3/1952 | Phillips | 160/236 |
| 2,759,544 | 8/1956 | Baruch | 181/295 |
| 2,849,077 | 8/1958 | Kopke | 181/210 |
| 2,855,039 | 10/1958 | Gross | 160/236 |
| 2,973,295 | 2/1961 | Rodgers, Jr. | 181/290 X |
| 3,031,013 | 4/1962 | Russell | 160/236 X |
| 3,713,508 | 1/1973 | Eckel | 181/287 |
| 3,772,129 | 11/1973 | Dover | 160/236 |
| 3,934,382 | 1/1976 | Gartung | 52/144 |
| 3,949,827 | 4/1976 | Witherspoon | 181/284 |
| 4,048,337 | 9/1977 | Bergstrom | 181/287 X |
| 4,083,395 | 4/1978 | Romano | 160/84 R |
| 4,127,183 | 11/1978 | McLarty | 181/224 |

FOREIGN PATENT DOCUMENTS

| | | | |
|---|---|---|---|
| 144570 | 6/1950 | Australia . | |
| 1149544 | 5/1963 | Fed. Rep. of Germany | 181/295 |
| 382424 | 11/1964 | Switzerland . | |
| 1442696 | 7/1967 | United Kingdom | 52/144 |

*Primary Examiner*—L. T. Hix
*Assistant Examiner*—Thomas H. Tarcza
*Attorney, Agent, or Firm*—Gausewitz, Carr, Rothenberg & Edwards

[57] ABSTRACT

An adjustable light and air-admitting thermal and acoustic barrier has a plurality of sound-attenuating blades pivotally mounted in a frame in a mutually spaced, parallel relationship. When the barrier is mounted at an open window, the blades may be adjusted to various open positions to allow desired amounts of outside light and air into a room, but cooperate in such open positions to form an effective sound trap for annoying outside sounds. Each of the blades functions as both a sound absorber and a sound transmission barrier, and comprises an elongated, relatively thin core of solid, sound-reflective material having longitudinally extending edge and intermediate flanges which define cavities on opposite sides of the core. Secured within the cavities by the flanges are strips of sound-absorbing insulating material, the core and insulating material being laterally enfolded by a cover secured to the flanges. When the blades are in their fully closed position, they form a thermal barrier to reduce heat gain or loss through the window.

5 Claims, 4 Drawing Figures

ADJUSTABLE LIGHT AND AIR-ADMITTING WINDOW THERMAL AND ACOUSTIC BARRIER SYSTEM

FIELD OF THE INVENTION

This invention relates generally to thermal and acoustic barriers and, more particularly, to an adjustable thermal and acoustic barrier which permits passage of both light and air.

BACKGROUND OF THE INVENTION

Nonair-conditioned structures are generally ventilated and cooled by opening one or more windows. However, the opened windows often admit not only a welcome breeze but the unwelcome din of nearby factories, airports, freeways, and the like.

The use of sound-absorbing drapes over the open window helps somewhat but can significantly impede both air flow and light transmission. Additionally, such drapes often offer little if any resistance to the transmission of sound. More specifically, such drapes are capable of only low absorption. Sound not absorbed within the drapery fabric or reflected from it is readily transmitted through the drape. Acoustical venetian blinds whose slats are constructed primarily of sound absorbent material afford somewhat improved air flow and light transmission characteristics but, like acoustic drapes, are only marginally effective with regard to both absorbing sound and blocking its transmission through the slats themselves.

A different acoustical problem arises in modern air-conditioned structures, such as office buildings, whose exterior rooms have quite large window area-to-wall area ratios. The large (and often fixed) windows now fashionable in such structures present a sound reverberation problem which must often be compensated for by relatively expensive acoustical treatment of the walls and other nonglass surfaces in the room. Because they lack the capability of effectively blocking the transmission of sound, acoustical drapes and blinds are a less than satisfactory solution to this internal sound problem. Although some of the sound generated within the room is absorbed by such drapes and blinds, a significant portion of it is transmitted through such devices, is reflected by the window and retransmitted through the drapes or blinds into the room.

The above-described problems are merely representative of many acoustical problems associated with windows, whether movable or fixed. It can be seen that a need exists for a sound barrier capable of absorbing sound and blocking its transmission yet permitting the passage of air and/or light therethrough when desired. Accordingly, it is an object of this invention to provide a sound barrier which eliminates or minimizes above-mentioned problems.

SUMMARY OF THE INVENTION

In carrying out principals of the present invention, in accordance with a preferred embodiment thereof, an adjustable light and air-admitting sound barrier comprises a plurality of sound-attenuating blades connected at opposite ends thereof to a support in mutually spaced relation for pivotal motion about mutually parallel axes. The blades are pivotable between a first position in which said blades abut one another along outer lateral portions thereof to form a continuous wall and a second position in which openings are formed between the blades through which light and air may pass. Each of the blades comprises an elongated, self-supporting core formed of a solid, sound-reflective material which functions as a mass barrier within the blade to impede the transmission of sound through it. Means are provided to define a plurality of longitudinally extending, outwardly opening cavities across the width of each side of the core. Sound-absorbing material is disposed within the cavities. The solid mass core and the sound-absorbing material within its cavities are covered by a flexible covering member wrapped completely laterally around the core and secured to it. According to a feature of the invention, the support comprises a frame, having a channel-shaped cross-section, surrounding the blades. The inner surface of the frame is lined with sound-absorbing material so as to absorb sound passing outwardly through the blade ends.

DETAILED DESCRIPTION

Figure 1:
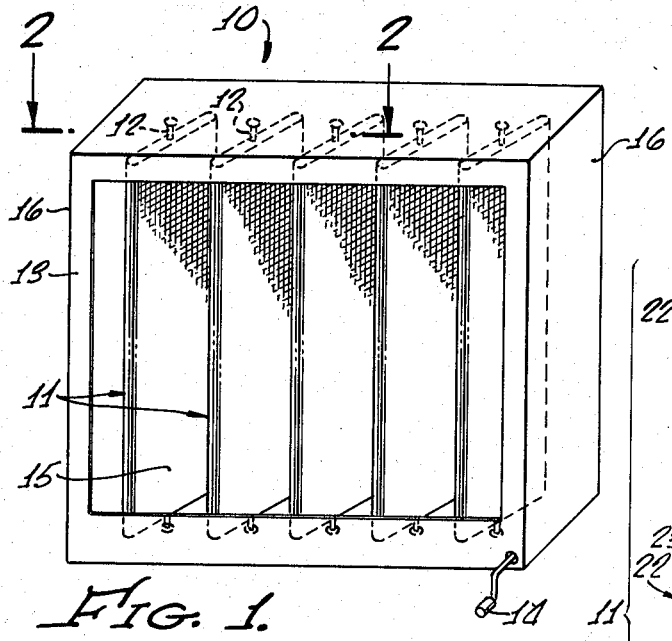
FIG. 1 is a perspective view of an adjustable thermal and acoustic barrier system embodying principles of the invention.
Figure 2:
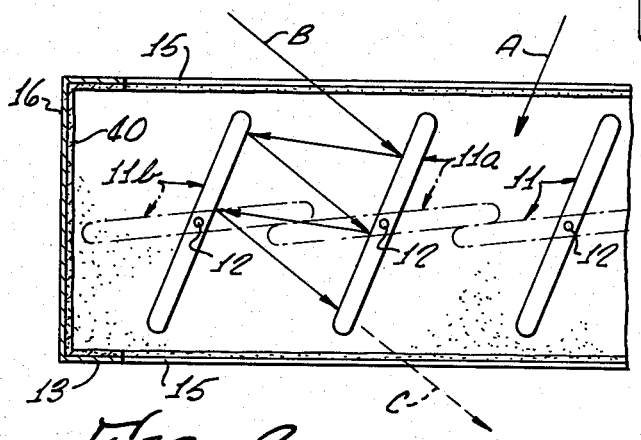
FIG. 2 is an enlarged partial cross-sectional view through the barrier system taken along line 2—2 of FIG. 1.

Principles of the present invention are illustrated in FIGS. 1 and 2 which show an adjustable sound barrier 10 that absorbs and blocks the transmission of sound yet permits the passage of both light and air across it when and to a degree desired. The sound barrier 10 comprises a plurality of elongated, parallel sound barrier blades or vanes 11 pivotally mounted on end pins 12 for rotation about their vertical axes within a frame 13 that has a channel-shaped cross-section. Preferably, all blades are identical to one another. Although under the present invention the blades 11 may be manually pivoted to various angular positions relative to the frame 13, they are preferably lined in a conventional manner for conjoint pivotal motion upon operation of a crank 14 or other suitable driving means. Additionally, the blades 11 are preferably slidably mounted in the frame 13 in a conventional manner well known in the art of louver manufacturing so that all can be moved to one side of the frame when desired to provide front-to-rear access through the frame opening 15.

Referring to FIG. 2, each of the blades is pivotable about pins 12 through approximately 90° in either direction from a fully open position (not shown) in which it is parallel to the side 16 of the frame 13 to fully closed positions, one of which is indicated by dashed lines, in which it laterally overlaps adjacent blades to form a continuous wall. In a normal sound-attenuating position (shown in solid lines in FIG. 2), the blades are all parallel to each other and in an angular position (inclined to the plane of the opening 15) intermediate their fully open and fully closed positions. The blades are mutually spaced apart within the frame by an equal distance which is less than the width of one blade. This causes each of the blades (other than the two end blades) in its fully closed position to be overlapped and abutted on opposite sides by its adjacent closed blades along a substantial portion (preferably about fifty percent) of its width.

To use the sound barrier 10 in conjunction with an openable window (not shown), the frame 13, which is sized to cover the window, is secured inwardly of it either by mounting the frame within the window frame opening or by securing it to inside wall surfaces around the window frame opening. With the frame 13 in place, the blades 11 all are moved to one side and the window is opened. The blades are then moved back across the frame 13 and pivoted to a desired operating position. As indicated by arrow "A" in FIG. 2, outside air and light are then both freely admitted to the room between each adjacent pair of blades 11. However, the blades 11 operate as a sound trap to greatly attenuate annoying outside noise from airports, freeways, factories and the like.

Each blade 11 is of a novel construction which permits it to act not only as a sound absorber, but also as a very effective sound transmission barrier.

Figure 3:
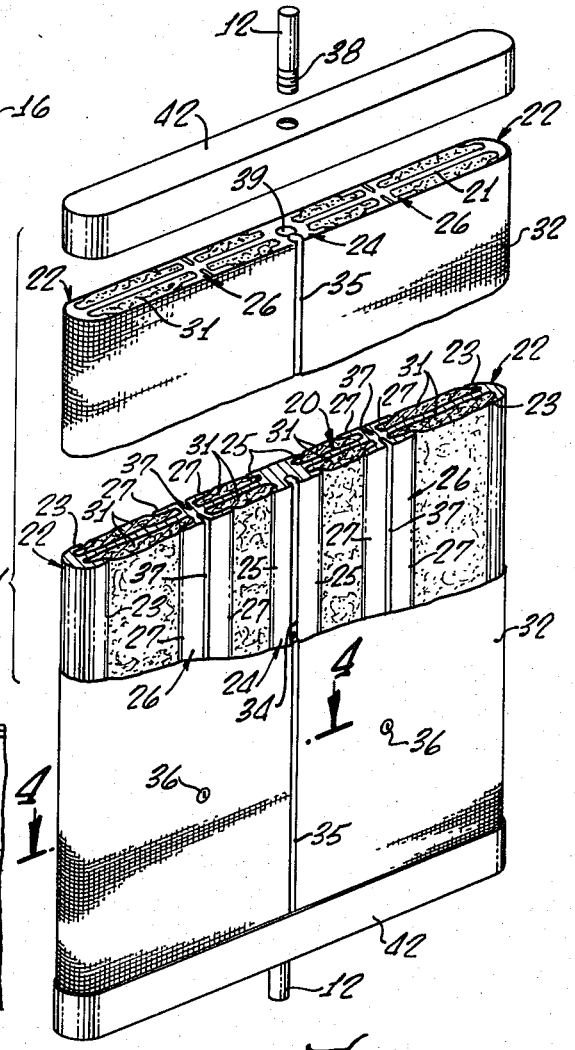
FIG. 3 is a partially exploded, fragmentary perspective view of a single sound-absorbing vane of the invention with portions cut away for clarity.

Before describing the adjustable sound-attenuating operation of the barrier 10, the novel blade construction which permits each blade to both absorb and block a large percentage of such outside sound will be described with reference to FIGS. 3 and 4. Extending along the entire length and width of each of the sound barrier blades 11 is a self-supporting extruded core or spine 20 formed from a material, such as aluminum or plastic, having a sufficient density and thickness so as to provide an effective barrier against transmission of sound. The extruded core 20 has a uniform cross-section throughout its length. The core comprises, in cross-section, a relatively thin web 21 which extends across the full width of the core 20 between a pair of generally C-shaped core side edge portions 22 whose curved opposite ends define laterally inwardly projecting lips 23 on opposite sides of and spaced apart from the web 21. Midway between the edge portions 22 and integral with the web 21 is an enlarged, generally circular central core portion 24 having outer end protrusions which define a pair of laterally extending lips 25 on opposite sides of and spaced apart from the web 21. Intermediate the central core portion 24 and each of the core edge portions 22 (either centered therebetween or offset to one side as desired), and also formed integrally with the web 21, is a generally I-shaped intermediate core portion 26 whose outer end portions also define a pair of laterally extending lips 27 on opposite sides of and spaced apart from the web 21.

The transversely enlarged side edge and intermediate portions 22, 24 and 26 of the core 20 define a plurality of longitudinally extending, outwardly opening cavities 30 on opposite sides of the core 20. In the illustrated embodiment, there are four such cavities on each side, although other numbers of cavities may be used. Within each of these cavities is placed a strip 31 of sound-absorbing insulation material such as rock wool. Alternatively, other sound-absorbing materials, such as insulating foam or fiberglass may be inserted or sprayed into the cavities. The lips 23, 25 and 27 function not only as cavity-defining means but also function as insulation-supporting means, slightly compressing side edge portions of the insulation strips 31 to secure them within the cavities 30. A length of blade-covering material 32, such as burlap, having side edges 33 is wrapped laterally around the core 20 to form an outer skin on the blade 11. Other cover materials, such as foam-backed or absorptive cloth may also be used. The covering material side edges 33 are inserted into a longitudinally extending groove 34 formed in one side of the central core member 24, between lips 25, and are frictionally locked therein by means of a rubber bead 35 that is pressed into the groove against the cover edges.

The covering material 32 is additionally secured to the intermediate rib or flange members 26 by suitable fasteners or adhesive such as, for example, self-tapping screws 36 which are threaded into longitudinally extending grooves 37 in the outer ends of the members 26. The end or pivot pins 12 have self-tapping threads 38 on their inner ends which are threaded into openings 39 formed in the ends of the central core portion 24.

Figure 4:
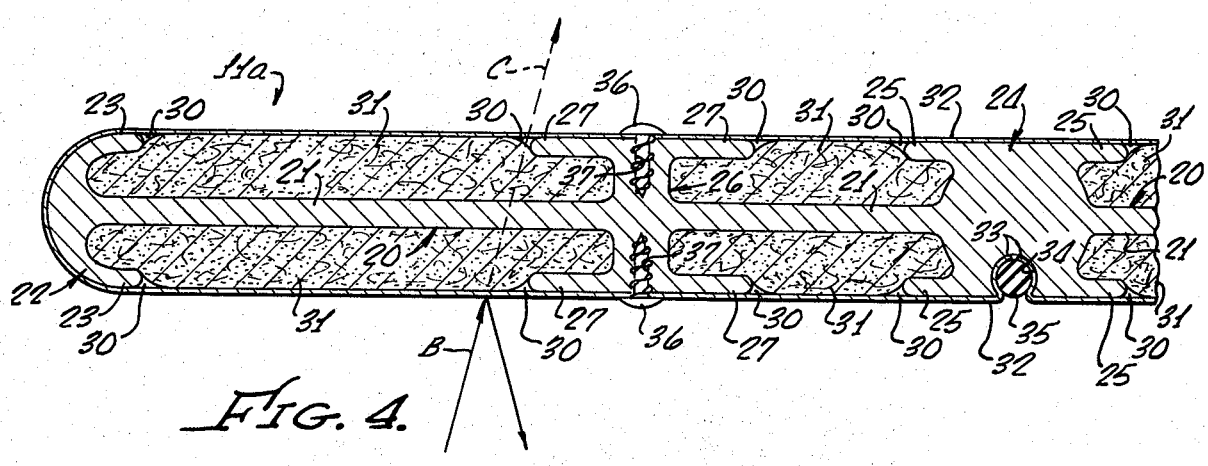
FIG. 4 is an enlarged, fragmented partial cross-sectional view of the vane taken along line 4—4 of FIG. 3.

Referring now to FIG. 4, the sound-attenuating operation of each blade 11 will be described. A sound wave "B" striking a blade **11*a* at an angle to its plane (the blade plane is defined as the plane bisecting the core from side edge to side edge and containing the longitudinal axis of the blade) initially strikes the covering 32. Significantly, the covering is formed of a material that reflects little so that sound incident thereon is primarily absorbed or transmitted. A portion of the sound is absorbed in the covering 32, a relatively minor portion is reflected, and the balance is transmitted to the cavity 30 where it strikes the sound absorbing insulation 31. The portion of the sound not absorbed within the insulation 31 or reflected from it strikes the core 20 which acts as a mass barrier, allowing transmission of only greatly attenuated sound. Attenuated sound transmitted through the core 20 is sequentially absorbed in the layers of insulating material 31 and covering 32 on the opposite side of the core so that the sound "C" actually passing through the blade 11*a*** is substantially attenuated relative to the initial sound "B" by all of the above factors.

By placing the sound-reflective barrier 20 within the blade 11 and enfolding it with the cover 32, the sound attenuating effectiveness of the blade 11 is substantially increased. The incoming sound "B" is met initially not by a sound-reflective surface, as would be the case if the transmission barrier 20 constituted the shell of the blade instead of its core, but by the at least somewhat sound-absorbent cover 32. Therefore, sound not absorbed by the cover is transmitted to the interior of the vane. There it is further absorbed by the material within the cavities. Sound that does strike the core 20 is, for the most part, reflected back to the absorption material on the incoming side of the core and further absorbed therein. Therefore, instead of being reflected from an outer reflective surface, a large part of the sound is caused to pass through the absorption material twice and thus the reflected sound is greatly attenuated by the described construction.

The embodiment of the blade construction illustrated in FIG. 4 may be modified in several manners if desired. In such illustrated embodiment, the primary sound absorption of the blade 11 is accomplished by the insulation material 31 in the blade cavities 30. This allows the covering 32 to function primarily in an aesthetic role. However, if desired, the insulation material 31 may be omitted and the relatively thin covering 32 replaced with a thicker, more efficient sound-absorbing material such as carpeting material or foam-backed cloth. Alternatively, both the inner insulation 31 and the thicker covering 32 may be used in combination to form a particularly effective sound-absorbing blade.

Referring again to FIG. 2, it can be seen that each adjacent pair of blades such as **11*a* and 11*b* in the typical sound-attenuating and light and air-admitting position indicated cooperate to form a series of sound traps in the barrier 10. The attenuated portion of sound "B" (of FIG. 4) which is initially reflected from the blade 11***a* (primarily from the blade core) is directed against the adjacent blade 11*b* where the sound-attenuating process previously described for the blade 11*a* is repeated. A still further diminished amount of sound is reflected from the core of blade 11*b* back to the blade 11*a*, etc., sequentially diminished portions of the initial sound "B" following the zigzag reflective course between the adjacent blades 11*a* and 11*b* illustrated in FIG. 2. The end result is that only the greatly diminished sound "C" actually reaches the inside of the room through the blade 11*a*. The total amount of sound attenuation increases with an increase in the number of times the sound is reflected back and forth between a pair of vanes as it travels along the multiple reflective path illustrated in FIG. 2. The number of reflections varies with the angle between vane planes and sound direction, and with the spacing of the vanes, increasing as the angle approaches 90° and as the vane spacing decreases.

To absorb and contain sound passing outwardly through the blade ends (longitudinally of the vanes), the interior surface of the frame 13 is insulated with a layer 40 of sound-absorbing material, the frame 13 itself acting additionally as a sound-transmission barrier.

It should be noted that the sound-attenuating process just described is effective to an adjustable degree relative to all outside sound propagated in a direction not parallel to the planes of the blades. Thus, even with the blades 11 in their fully open position, the barrier 10 still acts as a sound trap with regard to sound waves propagating in a direction not perpendicular to the frame opening 15. Of course, the blades may be pivoted to a wide variety of angular positions relative to outside sounds for selective and adjustable attenuation.

The placement of the sound-absorbing material exterior to the core renders the blades particularly efficient in their sound-absorbing mode. This allows them to be spaced apart so that they overlap by only about fifty percent of blade width which results in a substantial material cost savings. However, such fifty percent overlap not only results in a sufficiently long reflective path (between adjacent blades) for incoming sound waves, but forms a good seal between adjacent blades in their closed position which permits them to form an effective thermal barrier in such closed position. Thus, when the window is closed, the barrier 10 may also be used to significantly reduce heat gain or loss through the closed window. More or less lateral overlap percentage may be used based on such factors as material cost, length of reflective paths desired, etc.

Neither the construction nor operation of the sound barrier 10 is limited to that illustrated and previously described herein. For example, the blades 11 in the frame 13 may be installed horizontally across a window. Additionally, when it is desired, the blades 11 may be instead mounted in conventional venetian blind-supporting hardware. When this is done, the exposed blade ends (which would be covered by the frame 13) may be covered by means of sound-reflective caps 42 which act as sound barriers to impede outward transmission of sound through the blade ends.

The adjustable sound barrier 10 functions as a sound trap not only in an outside-to-inside direction (FIG. 2), but in an inside-to-outside direction as well, thus making it very useful in additionally controlling a variety of problems associated with the combination of windows and sounds generated within a structure. For example, an adjustable sound barrier of the invention may be placed over an open factory window to significantly reduce noise passsing outwardly through such window, yet allowing adequate light and ventilation to pass inwardly through it.

Also, a sound barrier 10 may be used to control the interior sound reverberation problem associated with modern offices having very large, fixed (because of air-conditioning systems) windows. Interior sounds from typewriters, duplicating equipment, etc., are reflected from such large glass areas and usually must be controlled by attempting to acoustically treat other room surfaces. However, window reverberation may be more effectively controlled, without significant blockage of light, by using a sound barrier 10 over such windows. Interior sounds approaching the windows are initially trapped by the cooperating blades as previously described. Sound passing through or between the blades is reflected by the glass back towards the room and is trapped in the reverse direction by the barrier 10, the double trapping effect substantially eliminating the sound reverberation problem.

The foregoing detailed description is to be clearly understood as given by way of illustration and example only, the spirit and scope of the invention being limited solely by the appended claims.

I claim:

1. An adjustable light and air-admitting thermal and acoustic barrier, comprising a plurality of sound and heat transfer attenuating blades pivotally mounted in longitudinally parallel and mutually spaced apart relation, each said blade comprising:

(a) a self-supporting core of sound reflective material, said core comprising
  (1) an elongated web,
  (2) generally C-shaped side edge flanges on said web having opposite ends defining laterally inwardly projecting lips on opposite sides of and spaced apart from said web, the lips of opposite side edge flanges extending towards each other substantially parallel to and spaced from the web to define longitudinally extending cavities on opposite sides of the web with the lips of said side edge flanges partially overlying and partially enclosing such cavities,
  (3) a plurality of strips of sound-absorbing insulating material positioned in respective ones of said cavities, said lips partly overlying said strips of sound-absorbing insulating material and compressing side edge portions thereof to secure said strips within said cavities, and
  (4) a sound-absorbing cover laterally enfolding said core, whereby said strips of sound-absorbing material are readily mounted upon said core and retained in said cavity by the side edge compression thereof.

2. The thermal and acoustic barrier of claim 1 wherein said web includes an intermediate core portion having outer end protrusions defining laterally extending lips on opposite sides of and spaced apart from said web, said intermediate core portion lips extending outwardly toward said side edge flange lips and overlying said web, said sound-absorbing insulating material strips each being confined between said intermediate core portion and a side edge flange on one side of said web and having side edge portions of such insulating material compressed between the web and the lips of the side edge flanges and of the intermediate core portion to thereby secure the sound-absorbing material to the core.

3. The thermal and acoustic barrier of claim 2 wherein said intermediate core portion has a longitudinally extending groove, opposite edge portions of said cover being frictionally locked in said groove.

4. The thermal and acoustic barrier of claim 2 wherein said web has a plurality of intermediate flanges secured to and projected outwardly from opposite sides of said web between side edge flanges and said intermediate core portion and extending longitudinally of said web, said cover being secured through to at least one of said intermediate flanges.

5. The thermal and acoustic barrier of claim 4 wherein said one intermediate flange has a longitudinally extending groove and wherein said cover is secured to said core by a self-tapping threaded fastener received in said groove.

* * * * *